US009178309B2

(12) United States Patent
Tanaka et al.

(10) Patent No.: US 9,178,309 B2
(45) Date of Patent: Nov. 3, 2015

(54) SOCKET WITH A METAL FITTING WITH A LOCK PORTION MOVABLE IN A WIDTH DIRECTION

(75) Inventors: Tomonori Tanaka, Mie (JP); Yoji Miyazaki, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/241,433

(22) PCT Filed: Aug. 22, 2012

(86) PCT No.: PCT/JP2012/005249

§ 371 (c)(1),
(2), (4) Date: Feb. 26, 2014

(87) PCT Pub. No.: WO2013/031139

PCT Pub. Date: Mar. 7, 2013

(65) Prior Publication Data

US 2014/0227899 A1 Aug. 14, 2014

(30) Foreign Application Priority Data

Aug. 31, 2011 (JP) ..... 2011-188826
Feb. 29, 2012 (JP) ..... 2012-043502

(51) Int. Cl.

| | |
|---|---|
| ***H01R 13/627*** | (2006.01) |
| ***H01R 13/631*** | (2006.01) |
| *H01R 12/71* | (2011.01) |
| *H01R 12/73* | (2011.01) |
| *H01R 13/20* | (2006.01) |

(52) U.S. Cl.

CPC ..... *H01R 13/631* (2013.01); *H01R 13/6271* (2013.01); *H01R 13/6275* (2013.01); *H01R 12/716* (2013.01); *H01R 12/73* (2013.01); *H01R 13/20* (2013.01)

(58) Field of Classification Search

USPC ..... 439/352–358

See application file for complete search history.

(56) References Cited

U.S. PATENT DOCUMENTS

| | | | | |
|---|---|---|---|---|
| 7,722,408 | B2 * | 5/2010 | Miyazaki et al. | 439/660 |
| 7,901,218 | B2 * | 3/2011 | Sato et al. | 439/74 |
| 8,052,457 | B2 * | 11/2011 | Miyazaki et al. | 439/357 |
| 8,845,339 | B2 * | 9/2014 | Ono | 439/74 |

(Continued)

FOREIGN PATENT DOCUMENTS

| | | | |
|---|---|---|---|
| CN | 1173056 | A | 2/1998 |
| CN | 101820114 | A | 9/2010 |

(Continued)

OTHER PUBLICATIONS

International Search Report issued in International Application No. PCT/JP2012/005249 with Date of mailing Nov. 27, 2012, with English Translation.

Search Report issued in corresponding Chinese Patent Application No. 201280041617.7, mailed on Jun. 30, 2015; 4 pages with English translation.

*Primary Examiner* — Chandrika Prasad

(74) *Attorney, Agent, or Firm* — McDermott Will & Emery LLP

(57) ABSTRACT

A header-side holding metal fitting 40 is provided with lock piece portions 42, which are movable in a width direction X of a connector 1 (a header housing 21) relative to a connection piece (a base portion) 41 of the header-side holding metal fitting 40. A socket-side holding metal fitting 30 is provided with lock holes (lock portions) 37 which are lockable to the lock piece portions 42.

8 Claims, 10 Drawing Sheets

(56) References Cited

U.S. PATENT DOCUMENTS

| | | | | |
|---|---|---|---|---|
| 2008/0268711 | A1* | 10/2008 | Miyazaki et al. | 439/626 |
| 2010/0221928 | A1 | 9/2010 | Sato et al. | |
| 2010/0248524 | A1* | 9/2010 | Miyazaki et al. | 439/357 |
| 2013/0280926 | A1* | 10/2013 | Ono | 439/65 |
| 2014/0227910 | A1* | 8/2014 | Tanaka et al. | 439/626 |
| 2014/0273587 | A1* | 9/2014 | Takenaga et al. | 439/345 |
| 2014/0370726 | A1* | 12/2014 | Kato et al. | 439/84 |

FOREIGN PATENT DOCUMENTS

| | | | |
|---|---|---|---|
| EP | 0 814 645 | A1 | 12/1997 |
| JP | 2001-057273 | A | 2/2001 |
| JP | 2007-095371 | A | 4/2007 |
| JP | 2008-270098 | A | 11/2008 |
| JP | 2008-270099 | A | 11/2008 |
| JP | 2008-300371 | A | 12/2008 |
| JP | 2010-225400 | A | 10/2010 |

* cited by examiner

SOCKET WITH A METAL FITTING WITH A LOCK PORTION MOVABLE IN A WIDTH DIRECTION

RELATED APPLICATIONS

This application is the U.S. National Phase under 35 U.S.C. §371 of International Application No. PCT/JP2012/005249, filed on Aug. 22, 2012, which in turn claims the benefit of Japanese Application No. 2011-188826, filed on Aug. 31, 2011 and Japanese Application No. 2012-043502, filed Feb. 29, 2012, the disclosures of which Applications are incorporated by reference herein.

TECHNICAL FIELD

The present invention relates to a socket, and a connector using the socket.

BACKGROUND ART

A connector including: a socket provided with multiple socket-side terminals as well as socket-side holding metal fittings disposed on a socket body; and a header provided with multiple header-side terminals as well as header-side holding metal fittings disposed on a header body, has heretofore been in use (see PTL 1, for example).

According to PTL 1, the socket and the header are fitted to each other to bring sets of the terminals respectively into contact and conduction with one another, and conductor patterns on circuit boards respectively connected to the sets of terminals are thus electrically connected to each other.

CITATION LIST

Patent Literature

[PTL 1] Japanese Patent Application Publication No. 2008-270099

SUMMARY OF INVENTION

Technical Problem

Meanwhile, in the technical field of connectors in recent years, there have been demands for reductions in size and thickness of a connector associated with a reduction in size of an instrument equipped with the connector. However, an attempt of reduction in size and thickness of a connector is liable to cause deterioration in feeling to be sensed when the socket and the header are brought into engagement with each other, or easy disengagement between the socket and the header. Such problems are attributed to a weakening engagement force between the socket and the header associated with the reduction in size and thickness of the connector, namely, reductions in the numbers of the socket-side terminals and the header-side terminals, and reductions in contact pressures between these terminals.

In view of the above, an object of the present invention is to provide a socket which can achieve good feeling at the time of engagement when used in a small connector and further reduce a risk of disengagement between a socket and the header, and to provide a connector using the socket.

Solution to Problem

For the purpose of achieving the foregoing object, a gist of a first feature of the present invention is a socket: including a socket body, on which socket-side terminals and a socket-side holding metal fitting are disposed; and being configured to engage the socket body with a header body, on which header-side terminals and a header-side holding metal fitting are disposed, and thereby to bring the socket-side terminals and the header-side terminals into contact. In the socket, the header-side holding metal fitting includes a lock piece portion being movable in a width direction of the header body relative to abase portion of the header-side holding metal fitting; and the socket-side holding metal fitting includes a lock portion lockable to the lock portion.

A gist of a second feature of the present invention is that the lock portion of the socket-side holding metal fitting is provided on two sides or one side of a peripheral wall portion in a width direction of the socket body so as to be situated in a line with the socket-side terminals.

A gist of a third feature of the present invention is that the lock portion is a lock hole formed in a penetrating manner in the width direction of the socket body.

A gist of a fourth feature of the present invention is that the lock portion is a step portion having a step in the width direction of the socket body.

A gist of a fifth feature of the present invention is that: the socket-side holding metal fitting includes a claw portion projecting inward in the width direction of the socket body; and a tip end portion of the claw portion serves as the lock portion.

A gist of a sixth feature of the present invention is that: the socket-side holding metal fitting includes a claw portion bent substantially into an inverted U shape in such a manner as to extend over the peripheral wall portion of the socket body; and the lock portion is formed in the claw portion.

A gist of a seventh feature of the present invention is that the tip end portion of the claw portion is buried in the socket body.

A gist of an eighth feature of the present invention is a connector using the socket.

Advantageous Effects of Invention

According to the present invention, the header-side holding metal fitting is provided with the lock piece portions, which are movable in the width direction of the header body relative to the base portion of the header-side holding metal fitting. Meanwhile, the lock portions lockable to the lock piece portions are formed on the socket-side holding metal fitting. Thus, it is possible to obtain the socket which can reduce a risk of the disengagement between the socket and the header when used in a small connector, and to obtain the connector using the same.

BRIEF DESCRIPTION OF DRAWINGS

FIG. 8(*a*) is a perspective view; and FIG. 8(*b*) is a cross-sectional view illustrating a state in which the first modified example is attached to the socket while viewed from the same position as is the main part of the connector shown in FIG. 7.

DESCRIPTION OF EMBODIMENTS

Embodiments of the present invention will be described below in detail with reference to the drawings.

Embodiment 1

Figure 1:
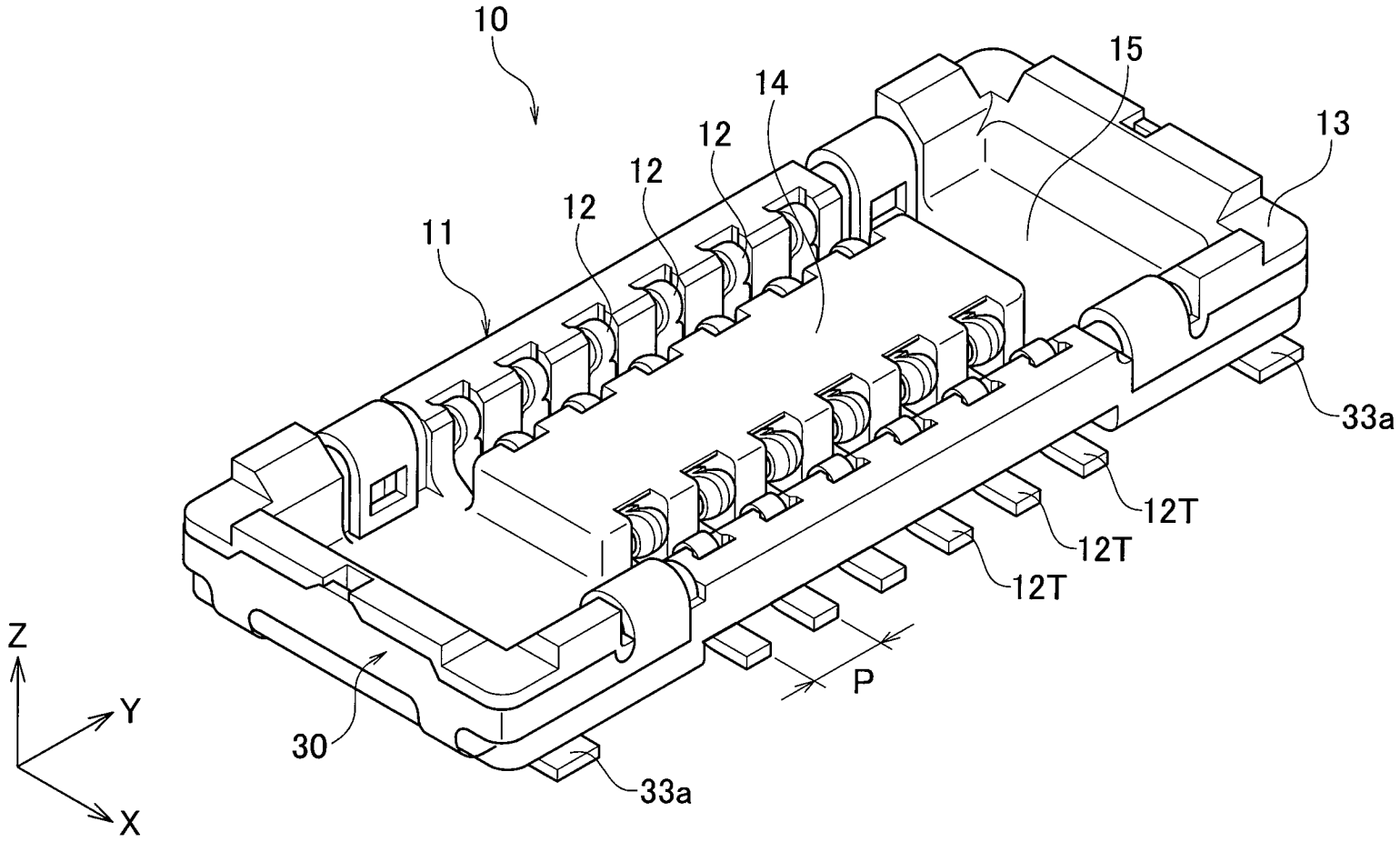
FIG. 1 is a perspective view showing a socket of a connector according to one Embodiment of the present invention.
Figure 2:
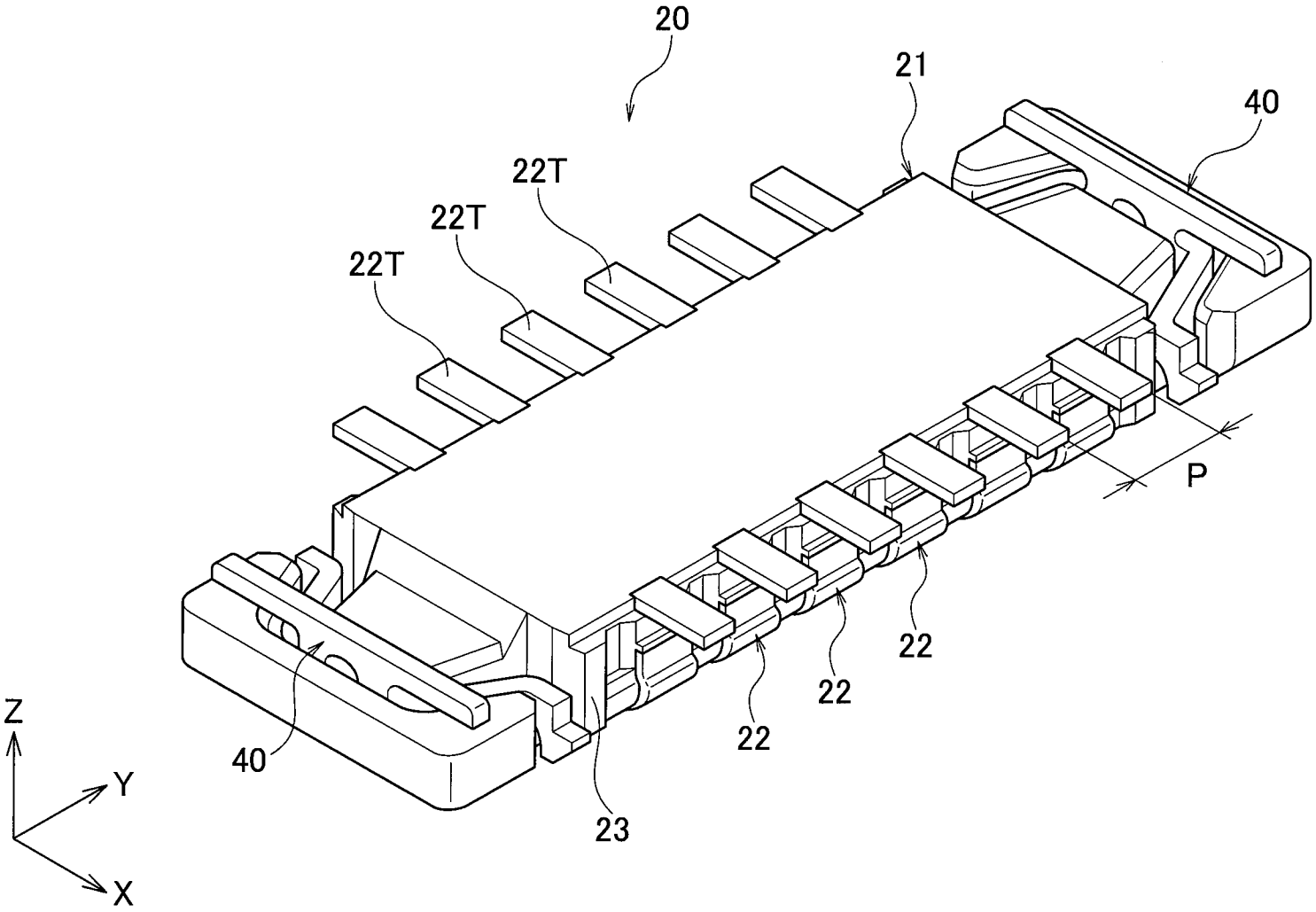
FIG. 2 is a perspective view showing a header of the connector according to one Embodiment of the present invention.
Figure 3:
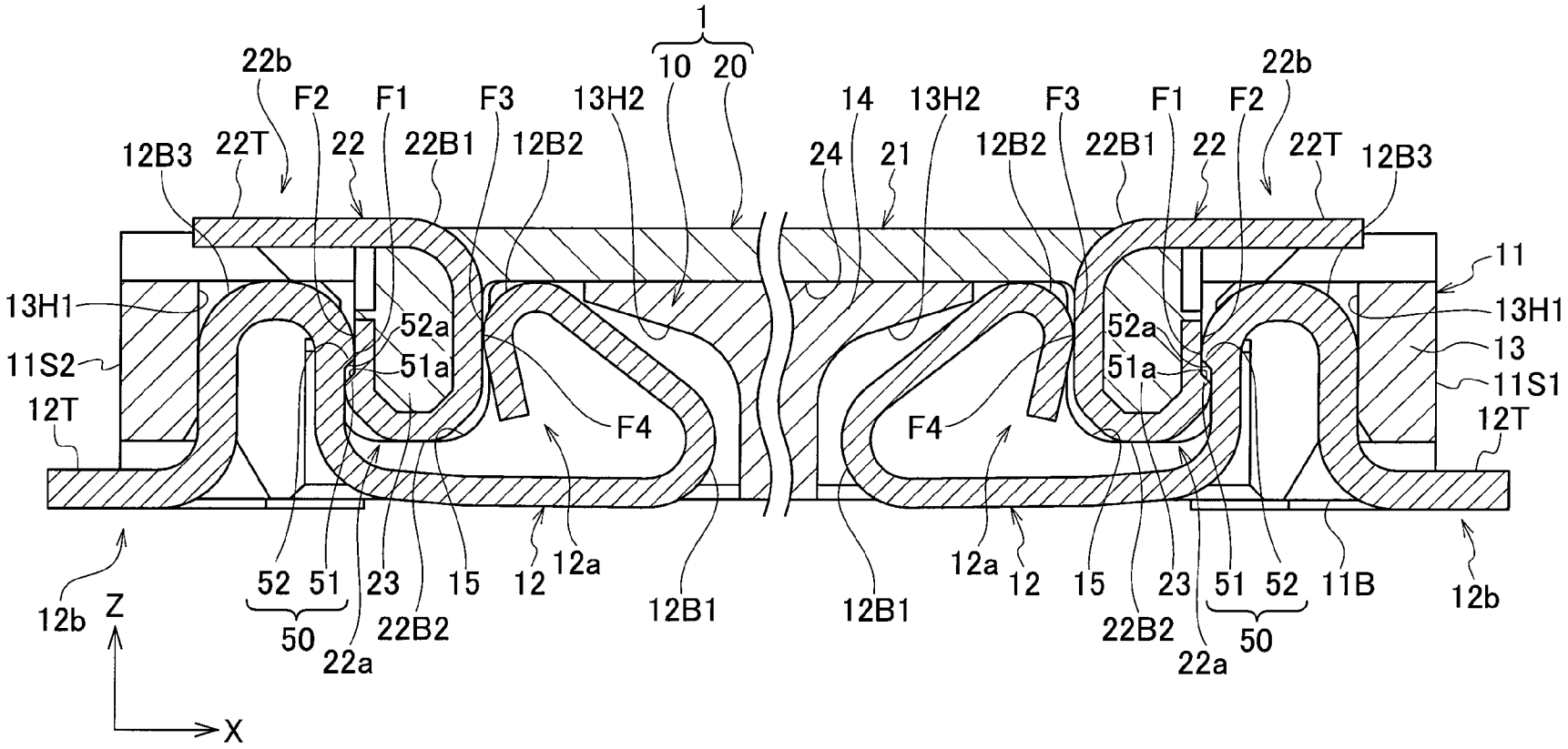
FIG. 3 is a cross-sectional view showing the connector according to one Embodiment of the present invention.

FIG. 1 to FIG. 7 are views showing one Embodiment of a connector 1 according to the present invention. As shown in FIG. 3, the connector 1 of this embodiment includes a socket 10 and a header 20 which are fitted to each other. In the description of this embodiment, the X direction in the drawings will be defined as a width direction of the connector 1 (a socket housing 11, a header housing 21), the Y direction therein will be defined as a longitudinal direction thereof, and the Z direction therein will be defined as a vertical direction thereof.

As shown in FIG. 1, the socket 10 includes the socket housing (a socket body) 11 which is made from an insulative synthetic resin and formed into a rectangular (oblong) shape as a whole in a plan view. In the socket housing 11, multiple contacts (socket-side terminals) 12 are disposed along mutually-opposed long sides of the socket housing 11 at a predetermined pitch P in the longitudinal direction Y. In addition, socket-side holding metal fittings 30 are disposed at two ends in the longitudinal direction Y of the socket housing 11.

The socket housing 11 includes: a peripheral wall portion which is continuously formed substantially into a rectangular annular shape along a peripheral edge portion of the socket housing 11; and an island portion 14 having a substantially rectangular shape which is formed in a central portion of the socket housing 11 with predetermined clearances from the peripheral wall portion 13. In addition, an engagement groove portion 15 allowing the header 20 to be fitted into the groove portion 15 is formed between the peripheral wall portion 13 and the island portion 14.

As shown in FIG. 3, each contact 12 is formed by bending a strip-shaped metal material that has a predetermined thickness. In a tip end portion 12*a* of the contact 12, a second bent portion 12B2 is formed by inwardly bending a tip end side of the contact 12 that is bent upward from a first bent portion 12B1. At a base end portion 12*b*, a third bent portion 12B3 is formed by bending the contact 12 into an inverted U shape. Moreover, a base end side of the third bent portion 12B3 forms a flat connection terminal portion 12T.

In this embodiment, as shown in FIG. 1 and FIG. 3, each contact 12 is attached to the socket housing 11 in such a manner that the second bent portion 12B2 projects into the engagement groove portion 15. At this time, the third bent portion 12B3 is fitted into a recessed portion 13H1 formed inside the peripheral wall portion 13, and the first bent portion 12B1 is fitted into a recessed portion 13H2 formed below the island portion 14. In this state, the connection terminal portions 12T of the contacts 12 project outward from a base end side (a lower edge) of the peripheral wall portion 13, and the connection terminal portions 12T are connected to a conductor pattern (terminals) on a not-illustrated first circuit board by soldering.

Meanwhile, as shown in FIG. 2, the header 20 includes the header housing (a header body) 21 which is made from an insulative synthetic resin and formed into a rectangular (oblong) shape as a whole. In the header housing 21, multiple posts (header-side terminals) 22 are disposed along mutually-opposed long sides of the header housing 21 at a pitch P, which is equal to the pitch P of the socket contacts 12, in the longitudinal direction Y. In addition, header-side holding metal fittings 40 are disposed at two ends in the longitudinal direction Y of the header housing 21.

The header housing 21 includes a peripheral wall portion which is continuously formed substantially into a rectangular annular shape along a peripheral edge portion of the header housing 21. A recessed portion 24 is formed inside the peripheral wall portion 23 (see FIG. 3).

As shown in FIG. 3, each post 22 is formed by bending a strip-shaped metal material that has a predetermined thickness as is the case with the socket contacts 12. At a tip end portion 22*a* of the post 22, a fifth bent portion 22B2 is formed by bending a tip end side of the post 22, that is bent upward from a fourth bent portion 22B1, into an inverted U shape in a retreating direction. Meanwhile, a substantially flat connection terminal portion 22T is formed in a base end portion 22*b*.

In addition, each post 22 is insert-molded in the header housing 21 with the fifth bent portion 22B2 located in such a manner as to extend over a tip end portion (a lower side in FIG. 3) of the peripheral wall portion 23 and with the base end portion 22*b* penetrating a root portion (an upper side in FIG. 3) of the peripheral wall portion 23. In this state, the contact terminal portions 22T of the header contacts 22 project outward from a lower edge of the peripheral wall portion 23, and the connection terminal portions 22T are connected to a conductor pattern (terminals) on a second circuit board B2, not illustrated, by soldering.

As shown in FIG. 3, the header 20 is fitted to the socket 10 by inserting and fitting the peripheral wall portion 23 of the header housing 21 into the engagement groove portion 15 of the socket housing 11. At this time, an outer side surface F1 on the tip end portion 12*a* side of the third bent portion 12B3 of each contact 12 comes into resilient contact with an outer side surface F2 on the tip end portion 22*a* side of the fifth bent portion 22B2 of the corresponding post 22. Meanwhile, an outer side surface F3 of the second bent portion 12B2 of the contact 12 comes into resilient contact with a flat outer side surface F4 of the corresponding post 22 between the fourth bent portion 22B1 and the fifth bent portion 22B2. As a consequence, the contacts 12 and the corresponding posts 22 are electrically connected to one another, and the conductor pattern on the first circuit board and the conductor pattern on the second circuit board B2 are thus electrically connected to each other.

Moreover, each contact 12 and each corresponding post 22 of this embodiment are provided with a lock mechanism 50 configured to retain a bonded state between the socket 10 and the header 20 by establishing engagement between the mutually opponent terminals.

The lock mechanism 50 of this embodiment includes a first step portion 51 formed on the outer side surface F2 of the post 22, and a second step portion 52 formed on the outer side surface F1 of the contact 12.

The first step portion 51 is formed by thinning a lower side (which is an upper side in FIG. 3) of a contact-12-contacting surface on the outer side surface F2 of the post 22 by an inclined stepped surface 51*a*. In the meantime, the second step portion 52 is formed by thinning a lower side of a post-22-contacting surface on the outer side surface F1 of the contact 12 by an inclined stepped surface 52*a*.

Accordingly, when the header 20 is fitted to the socket 10, the outer side surfaces F2 and F4 of the post 22 are inserted while pushing the outer side surfaces F1 and F3 of the contact 12 open against their elastic forces. Thus, the first step portion 51 goes over the second step portion 52 and the step portions are fitted to each other. Then, the stepped surface 51*a* of the first step portion 51 and the stepped surface 52*a* of the second step portion 52 mesh with each other, so that the socket 10 and the header 20 can be locked to each other to retain the bonded state.

In the meantime, when the socket 10 and the header 20 are detached, the socket 10 and the header 20 are pulled away in detaching directions. Thus, the stepped surface 51*a* of the first step portion 51 and the stepped surface 52*a* of the second step portion 52 slide on each other and the outer side surfaces F1 and F3 of the contact 12 are pushed open. Thereby, the first step portion 51 and the second step portion 52 are disengaged from each other. In this state, the socket 10 and the header 20 can be separated from each other.

Figure 4:
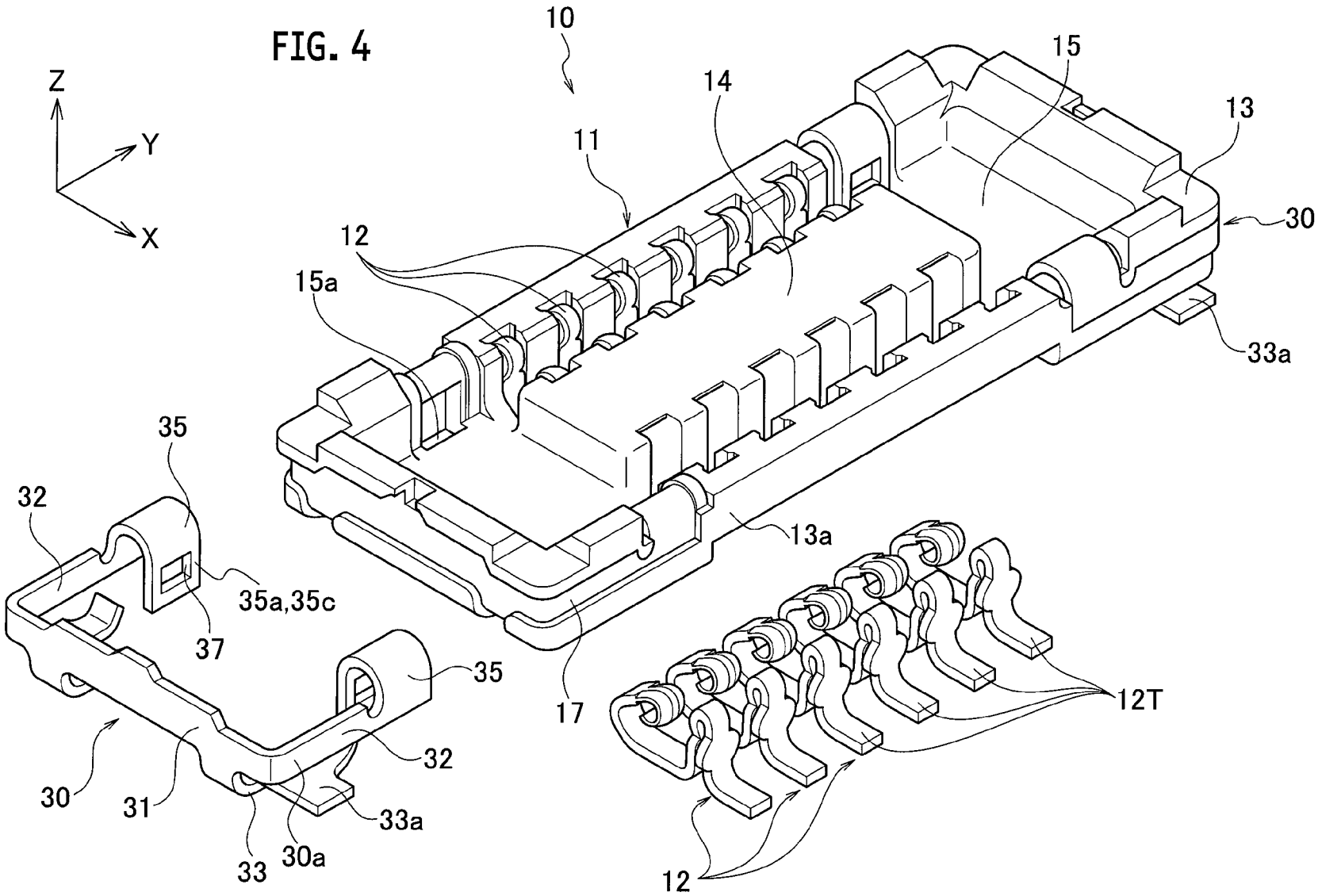
FIG. 4 is an exploded perspective view of the socket shown in FIG. 1, illustrating a state where a socket-side holding metal fitting and socket-side terminals located on one long side are detached from the socket.
Figure 5:
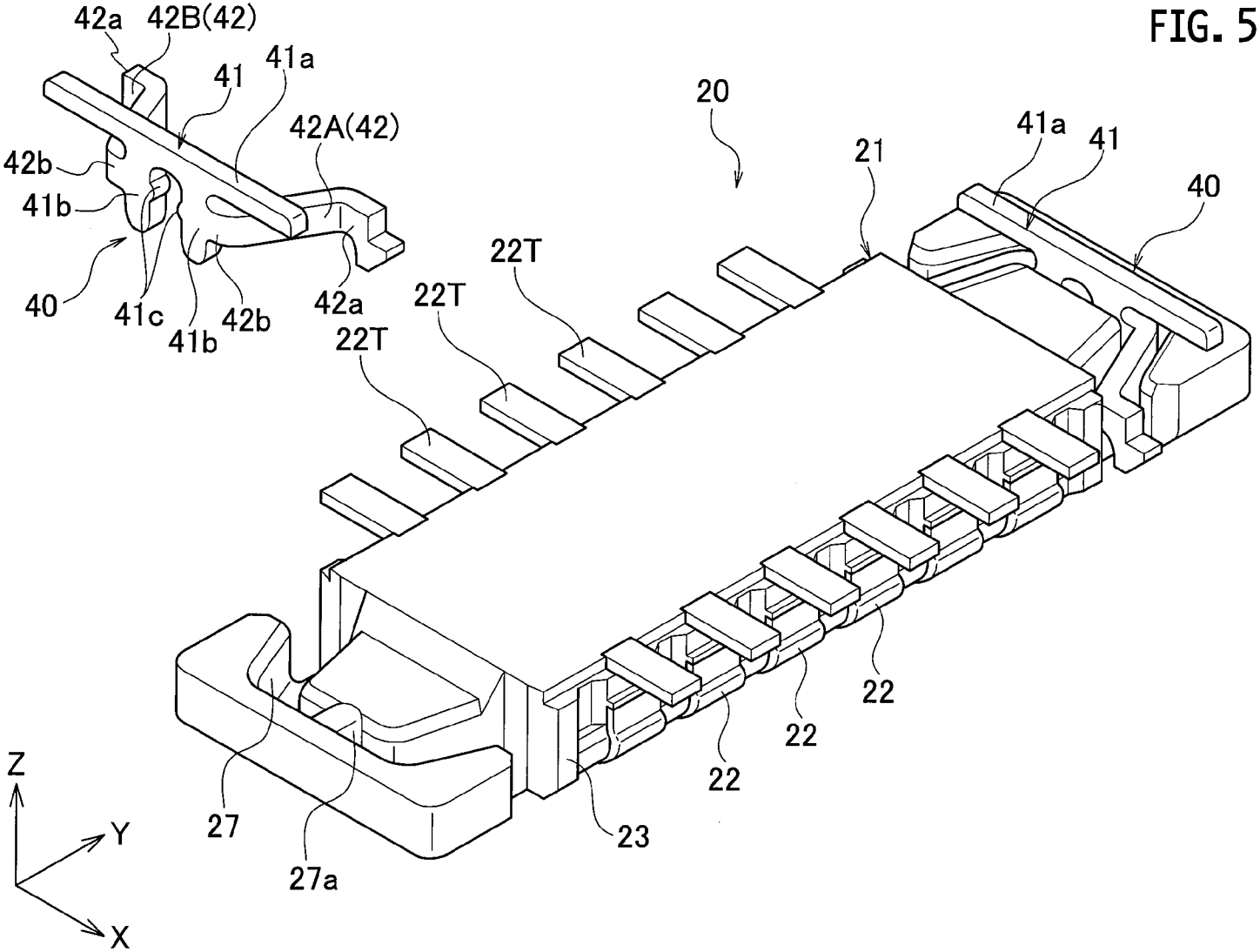
FIG. 5 is an exploded perspective view of the header shown in FIG. 2, illustrating a state where a header-side holding metal fitting is detached from the header.

FIG. 4 is an exploded perspective view of the socket 10, illustrating a state where one of the socket-side holding metal fittings 30 and the contacts 12 located on one side are detached from the socket 10. FIG. 5 is an exploded perspective view of the header 20, illustrating a state where one of the header-side holding metal fittings 40 is detached from the header 20. The socket-side holding metal fittings 30 and the header-side holding metal fittings 40 are used to increase strengths of the socket housing 11 and the header housing 21, and to fixedly attach attachment pieces 33*a* and 41*a*, which are respectively provided to the metal fittings 30 and 40, to the above-described circuit boards.

Moreover, the attachment pieces 33*a* of the socket-side holding metal fittings 30 are soldered to the first circuit board. Thus, the attachment pieces 33*a* firmly bond the socket 10 to the first circuit board in combination with the connection terminal portions 12T of the contacts 12 which are soldered to the first circuit board.

In the meantime, the attachment pieces 41*a* of the header-side holding metal fittings 40 are soldered to the second circuit board. Thus, the attachment pieces 41*a* firmly bond the header 20 to the second circuit board in combination with the connection terminal portions 22T of the posts 22 which are soldered to the second circuit board.

According to the above-described configuration, the socket 10 and the header 20, which are firmly bonded to the corresponding circuit boards, can be fitted to each other. Thus, the contacts 12 and the posts 22 are brought into contact and conduction with one another so that the conductor patterns on the respective circuit boards can be electrically connected to each other. In addition, since the contacts 12 and the posts 22 are provided with the lock mechanisms 50 as described above, it is possible to retain the boded state between the socket 10 and the header 20.

However, in the technical field of connectors in recent years, there have been demands for reductions in size and thickness. To satisfy the demands, the numbers of the contacts 12 and the posts 22 sometimes needs to be reduced as in the connector 1 of this embodiment. As a consequence, an engagement force between the socket 10 and the header 20 may be weakened and the engagement between the header 10 and the socket 20 may easily be released by a drop impact or the like.

In this embodiment, each head-side holding metal fitting 40 is provided with lock piece portions 42 which are movable in the width direction X of the connector 1 (the header housing 21) relative to a connection piece (a base portion) 41 of the header-side holding metal fitting 40. On the other hand, lock holes (lock portions) 37 lockable to the lock piece portions 42 of the header-side holding metal fitting 40 are formed on the corresponding socket-side holding metal fitting 30.

As shown in FIG. 4, each socket-side holding metal fitting 30 is formed by pressing a metal plate having a predetermined thickness. The socket-side holding metal fitting 30 includes aside plate portion 31 and a bottom plate portion 33. The side plate portion 31 extends in the width direction X of the connector 1 (the socket housing 11). The bottom plate portion 33 is formed by bending lower sides on two end portions of the side plate portion 31 almost perpendicularly toward the center in the longitudinal direction Y. Moreover, attachment pieces 33*a* are formed by causing two end portions of the bottom plate portion 33 to project outward from two sides of the connector 1 in the width direction X.

In addition, the side plate portion 31 includes extended portions 32 which are formed by bending two end portions in the width direction X of the side plate portions 31 almost perpendicularly toward the center in the longitudinal direction Y of the connector 1. Moreover, a claw portion 35 which is bent substantially into an inverted U shape in such a manner as to extend over the peripheral wall portion 13 of the socket housing 11 is provided at a terminal end portion in the direction of extension of each extended portion 32. The lock hole 37 is formed on a tip end 35*a* side of the claw portion 35.

The above-described socket-side holding metal fittings 30 are used by being fitted respectively into engagement groove portions 17 formed at two ends in the longitudinal direction Y of the socket housing 11. Specifically, in this embodiment, the socket-side holding metal fittings 30 are formed integrated with the socket housing 11 by insert molding, for example. Here, each engagement groove portion 17 has such a groove depth to make an outer wall surface 13*a* of the peripheral wall portion 13 substantially flush with an outer wall surface 30*a* of the socket-side holding metal fitting 30. In other words, the socket-side holding metal fitting 30 is formed integrated with the socket housing 11 in such a manner that the outer wall surface 30*a* of the socket-side holding metal fitting 30 is exposed to the outer wall surface 13*a* of the peripheral wall portion 13 substantially in the flush state. At this time, recessed portions 15*a* each in a two-stepped shape are formed on the engagement groove portion 15 at positions corresponding to the claw portions 35 of the socket housing 11. The tip end portions 35*a* of the claw portions 35 are formed integrated with the recessed portions 15*a* in such a manner that the tip end portions 35*a* are fitted into the recessed portions 15*a*.

As described above, in this embodiment, each of four lock holes 37 in total is provided to the socket-side holding metal fittings 30 so as to be situated in a line with the contacts 12 in a way that a pair of the lock holes 37 are arranged in the width direction X of the connector 1 and the other pair of the lock holes 37 are arranged in the longitudinal direction Y of the connector 1.

In the meantime, each header-side holding metal fitting 40 is formed by pressing a metal plate having a predetermined thickness as in the case of the socket-side holding metal fittings 30. As shown in FIG. 5, the header-side holding metal fitting 40 of this embodiment includes the connection piece (the base portion) 41, and a first lock piece portion 42A and a second lock piece portion 42B which project from the connection piece to form a substantially inverted V shape (or more specifically, a substantially flared shape).

The connection piece 41 includes the attachment piece 41*a* located at a position on an upper side in the vertical direction Z in a state of attachment to the header housing 21, and a pair of branch pieces 41*b* branching downward into a fork shape from the attachment piece 41*a* that extends in the width direction X. While the attachment piece 41*a* is used to establish attachment and fixation to the above-described second circuit board B2, stepped projections 41*c* are respectively provided on facing surfaces of the pair of branch pieces 41*b*.

The above-described header-side holding metal fittings 40 are used by being fitted respectively into engagement groove portions 27 formed at two ends of the header housing 21 in the longitudinal direction Y. Here, although illustration is omitted in FIG. 5, a central inner wall portion 27*a* of each engagement groove portion 27 is provided with a pair of steps corresponding to the above-described projections 41*c*. Each header-side holding metal fitting 40 is fitted into the engagement groove portion 27 by pushing the header-side holding metal fitting 40 in such that the projections 41*c* thereon go over the aforementioned steps.

Note that each engagement groove portion 27 is recessed substantially into the same shape as that of the header-side holding metal fitting 40, and has such a groove depth to make the attachment piece 41*a* substantially flush with the corresponding connection terminal portion 22T of the post 22 with the header-side holding metal fitting 40 in the fitted state.

Figure 6:
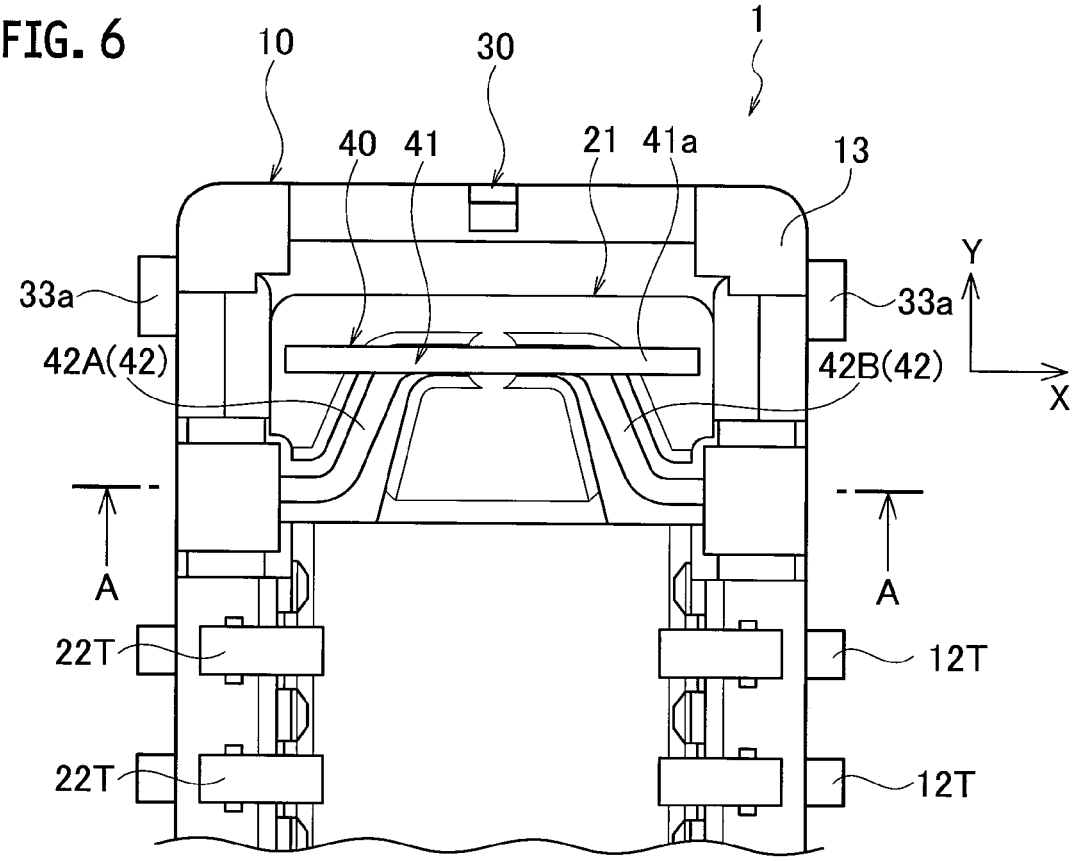
FIG. 6 is a plan view showing main part of the connector according to one Embodiment of the present invention.
Figure 7:
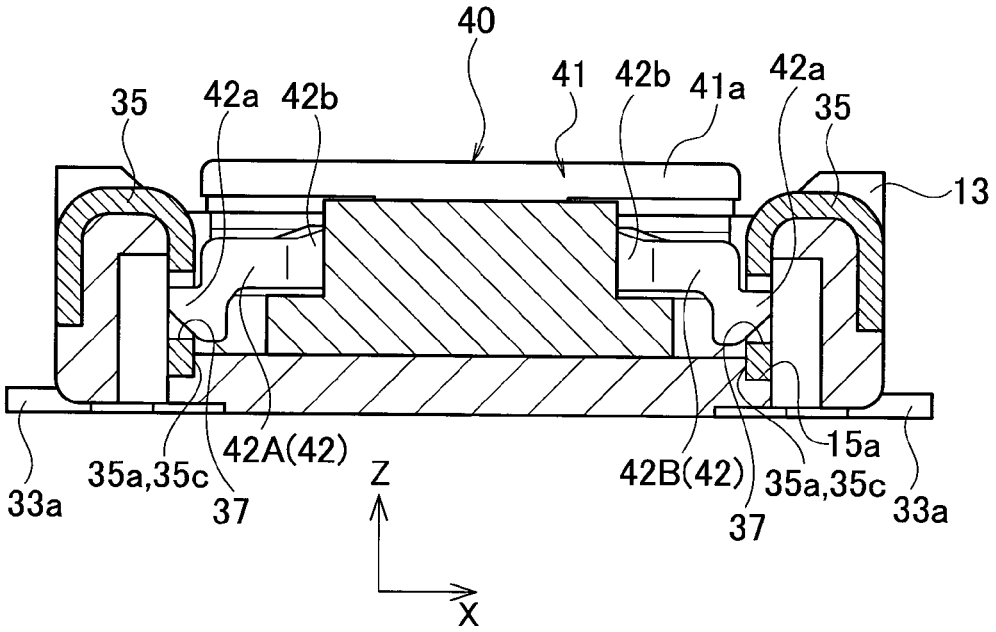
FIG. 7 is a cross-sectional view of the main part of the connector taken along the A-A line in FIG. 6.

FIG. 6 is a plan view showing main part of the connector 1 when the socket 10 and the header 20 are in the engaged state, and FIG. 7 is a cross-sectional view of the main part of the connector 1 taken along the A-A line in FIG. 6. As shown in FIG. 6 and FIG. 7, in this embodiment, the lock piece portions 42 of the header-side holding metal fitting 40 are inserted into the lock holes 37 of the socket-side holding metal fitting 30 by engaging the header 20 with the socket 10.

Specifically, a tip end portion 42*a* of each lock piece portion 42 has such a dimension as to make the tip end portion 42*a* slightly project outward in the width direction X from an outer wall inner side surface 35*c* of the corresponding claw portion 35 of the socket-side holding metal fitting 30. Then, the tip end portion 42*a* of the lock piece portion 42 is moved in a sliding manner to the lock hole 37 while being pushed by the outer wall inner side surface 35*c* of the claw portion 35. Thus, the tip end portion 42*a* of the lock piece portion 42 returns to the original state by resilience at the lock hole 37, whereby the tip end portion 42*a* of the lock piece portion 42 is inserted and attached into the lock hole 37.

As described above, the lock piece portions 42 and the lock holes 37 of the connector 1 of this embodiment makes it possible to lock each lock piece portion 42 and the corresponding lock hole 37 together, when the socket 10 and the header 20 are moved in pullout directions (mutually retracting directions in the vertical direction Z). Thus, it is possible to increase the engagement force between the socket 10 and the header 20, and to further reduce a risk of disengagement between the socket 10 and the header 20 even in the case of the connector 1 having fewer contacts 12 and posts 22 as in this embodiment.

As described above, in this embodiment, each header-side holding metal fitting 40 is provided with the lock piece portions 42 which are movable in the width direction X of the connector 1 (the header housing 21) relative to the connection piece (the base portion) 41 of the header-side holding metal fitting 40. Moreover, the lock holes (the lock portions) 37 lockable to the lock piece portions 42 of the header-side holding metal fitting 40 are formed on the corresponding socket-side holding metal fitting 30. For this reason, when the socket 10 and the header 20 are fitted to each other, the lock piece portions 42 can be fitted into the lock holes (the lock portions) 37. Thus, it is possible to achieve good feeling at the time of the engagement. Meanwhile, when the socket 10 and the header 20 attempt to be moved in the pullout directions, the header-side holding metal fitting 40 is locked by the lock holes (the lock portions) 37. Thus, it is possible to further reduce the risk of disengagement between the socket 10 and the header 20.

Particularly, in this embodiment, the lock piece portions 42 are formed to be expandable and contractible (elastically deformable) in the width direction X of the connector 1, so that the feeling at the time of the engagement can further be improved by use of the resilience of the lock piece portions 42.

In the meantime, in this embodiment, the lock portions are formed as the lock holes 37 which are penetrated in the width direction X of the connector 1 (the socket housing 11). For this reason, it is possible to insert and attach the lock piece portions 42 of the header-side holding metal fitting 40 into the lock holes 37 of the socket-side holding metal fitting 30, and thereby to further reduce the risk of disengagement between the socket 10 and the header 20.

In addition, in this embodiment, each of the lock holes (the lock portions) 37 of the socket-side holding metal fittings 30 is provided so as to be situated in a line with the contacts 12. Accordingly, it is possible to locate the lock holes (the lock portions) 37 in the four corners of the socket housing 11 by effectively using spaces near the contacts 12. Thus, it is possible to further reduce the risk of disengagement between the socket 10 and the header 20 in combination with the lock piece portions 42 to be locked in the lock holes (the lock portions) 37.

Furthermore, in this embodiment, each of the lock holes (the lock portions) 37 is provided to the peripheral wall portion 13 on the two sides of the socket housing (the socket body) 11 in the width direction X so as to be situated in a line with the contacts 12. For this reason, as compared to a configuration disclosed in Japanese Patent Application Publication No. 2010-225400, or more specifically, the configuration in which the lock holes (the lock portions) 37 are provided in the peripheral wall portion 13 on two sides of the socket housing 11 in the longitudinal direction Y, for example, the configuration of this embodiment has an advantage that it is possible to further reduce the risk of disengagement between the socket 10 and the header 20 when a pullout force is applied in an oblique direction by means of lifting up one side in the width direction X and the like. Specifically, in the configuration described above, if the pullout force is applied in the oblique direction, release timings take place at two steps of: firstly releasing the engagement between the lock holes (the lock portions) 37 and the lock piece portions 42; and then releasing the engagement of the lock mechanisms 50 between the contacts 12 and the posts 22.

On the other hand, since the lock holes (the lock portions) 37 are provided on the two sides of the peripheral wall portions 13 in the width direction X in this embodiment, it is possible to align the timing of releasing the engagement between the lock holes (the lock portions) 37 and the lock piece portions (42) with the timing of releasing the lock mechanisms 50. Thus, it is possible to further reduce the risk of disengagement between the socket 10 and the header 20. Although the lock holes (the lock portions) 37 are provided on the two sides of the peripheral wall portion 13 in the longitudinal direction Y of the socket housing 11 in the embodiment, a configuration may be applied in which the lock holes (the lock portions) 37 are provided only on one side of the peripheral wall portion 13.

Furthermore, in this embodiment, each socket-side holding metal fitting 30 includes the claw portions 35 each being bent substantially into the inverted U shape in such a manner as to extend over the peripheral wall portion 13 of the socket housing 11, and the lock hole (the lock portion) 37 is formed at each claw portion 35. For this reason, when the socket-side holding metal fitting 30 is attached to the socket housing 11, the claw portion 35 into the substantially inverted U shape is fitted from an upper side into the peripheral wall portion 13 of the socket housing 11. Thus, the socket-side holding metal fitting 30 can be firmly attached to the socket housing 11 with increased rigidity. In addition, the provision of the claw portions 35 facilitates the formation of the lock holes (the lock portions) 37 in such a manner as to be opposed to the lock piece portions 42.

Meanwhile, in this embodiment, the tip end portion 35*a* of each claw portion 35 is buried in the socket housing 11. As a consequence, the socket-side holding metal fitting 30 can be attached further firmly to the socket housing 11. Thus, it is possible to further suppress the disengagement of the socket-side holding metal fitting 30 at the time of application of an external force such as a drop impact.

Moreover, in this embodiment, the header-side holding metal fitting 40 includes the first lock piece portion 42A and the second lock piece portion 42B, which project from the connection piece (the base portion) 41 to form the substantially inverted V shape. For this reason, the two sides of the connector 1 in the width direction X can be locked by use of the first lock piece portion 42A and the second lock piece portion 42B. Thus, it is possible to further reduce the risk of the disengagement between the socket 10 and the header 20.

Particularly, in this embodiment, the first lock piece portion 42A and the second lock piece portion 42B are collectively formed into the substantially flared shape. In other words, the tip end portions 42*a* of the first and second lock piece portions 42A and 42B are bent from the inclinations of the base portions 42*b* outward in the width direction X, and are thus formed to be bent parallel to the width direction X of the connector 1. Accordingly, when the socket 10 and the header 20 attempt to be moved in the pullout directions, the tip end portions 42*a* are locked with depths (with long lock widths) by the lock holes (the lock portions) 37. Thus, it is possible to further reduce the risk of the disengagement between the socket 10 and the header 20. In addition, when the tip end portions 42*a* of the first and second lock piece portions 42A and 42B are inserted into the lock holes (the lock portions) 37, the first and second lock piece portions 42A and 42B swiftly returns to the original state by resilience. Thus, click feeling constituting the feeling at the time of the engagement is further improved as well.

This embodiment has shown the example where the first lock piece portion 42A and the second lock piece portion 42B of the header-side holding metal fitting 40 are formed substantially into the inverted V shape. However, the present invention is not limited only to this configuration and various changes are possible. For example, as the header-side holding metal fitting 40, one may be used which is formed by use of the connection piece (the base portion) 41, the first lock piece portion 42A, and the second lock piece portion 42B in away that its external shape looks substantially like an inverted letter U. In this case, it is possible to-secure a large space for the form of the header housing 21 to be disposed between the pair of lock piece portions 42A and 42B when the header housing 21 is in the attached state. Thus, there is an advantage that it is possible to increase strength of the header housing 21.

Specifically, when the first lock piece portion 42A and the second lock piece portion 42B are formed substantially into the V shape, it is necessary to design a header housing 21-forming portion to be located between the pair of lock piece portions 42A and 42B into a trapezoidal shape that gradually shrinks toward the connection piece 41. On the other hand, when the header-side holding metal fitting 40 is formed substantially into the inverted U shape, it is possible to design the forming portion to be located between the lock piece portions 42A and 42B substantially into a broad rectangular shape without shrinkage. As a consequence, it is possible to increase the strength of the header housing 21 and to further reduce a risk of damage on the header housing 21 even if the header-side holding metal fitting 40 is repeatedly attached to the header housing 21.

Alternatively, one or more header-side holding metal fittings 40 may be used, each of which is formed by use of the lock piece portion 42 and the connection piece (the base portion) 41 in away that its external shape looks substantially like a letter L or T, and each of which has a single lock piece portion 42. In this case, it is preferable to use four such header-side holding metal fittings 40 corresponding to the lock holes (the lock portions) 37 of the socket-side holding metal fittings 30 located in the four corners of the socket housing 11. In this configuration, the header-side holding metal fitting 40 can be formed into a simple shape. Thus, there are advantages that it is easy to conduct metal machining and that it is possible to reduce waste materials in the course of metal machining.

Furthermore, the lock piece portions 42 (42A and 42B) of the header-side holding metal fitting 40 may be each bent substantially into an S shape. This configuration can secure a sufficient spring length for each lock piece portion 42, so that an amount of deflection of the lock piece portion 42 can be dispersed by use of the respective R portions when the tip end portion 42*a* of the lock piece portion 42 is caused to slide on the outer wall inner side surface 35*c* of the claw portion 35. Thus, this configuration has an advantage that it is possible to reduce a settling amount of the lock piece portion 42.

Next, modified examples of the socket-side holding metal fitting 30 of this embodiment will be described with reference to FIG. 8 to FIG. 12.

Figure 8:
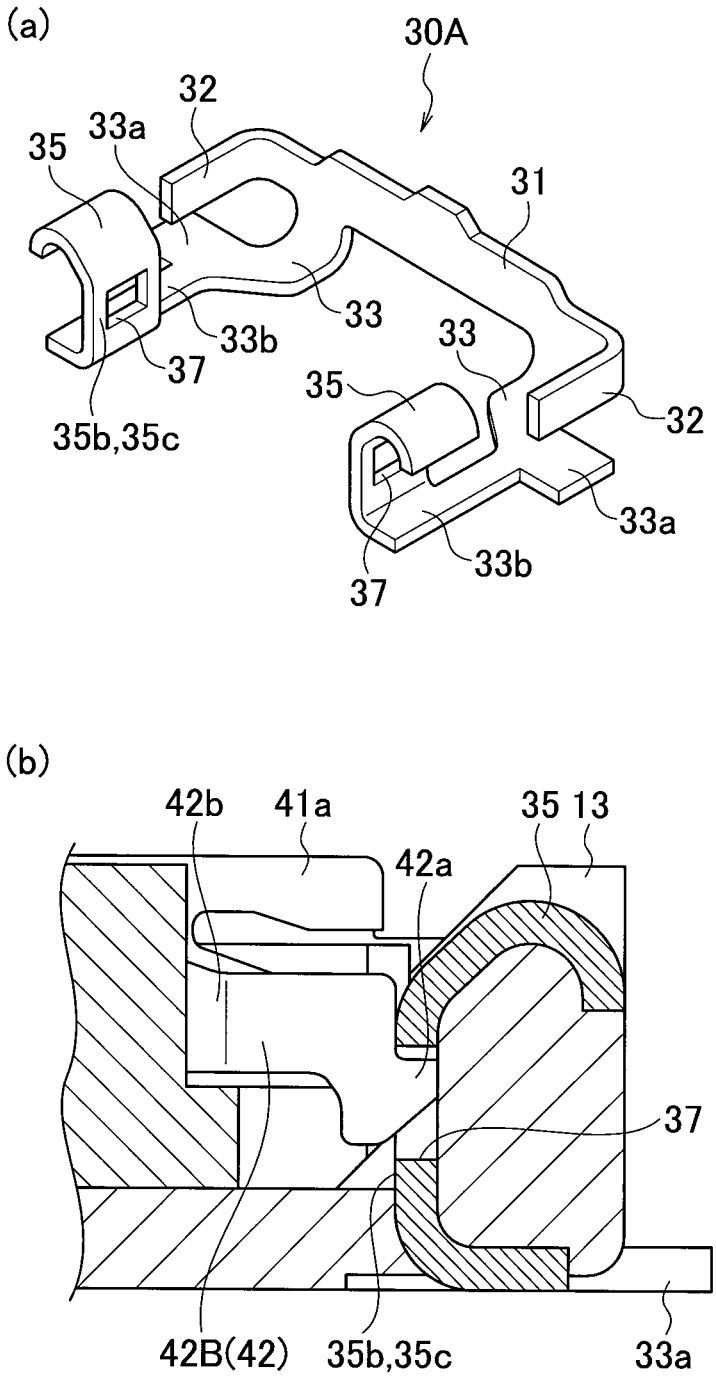
FIGS. 8(*a*) and 8(*b*) are views showing a first modified example of the socket-side holding metal fitting according to the embodiment of the present invention.

FIGS. 8(*a*) and 8(*b*) are views showing a socket-side holding metal fitting 30A of a first modified example. This modified example is different from the embodiment mainly in that the claw portion 35 provided with the lock hole (the lock portion) 37 is placed upright on the bottom plate 33 side of the socket-side holding metal fitting 30A.

To be more precise, in addition to the attachment piece 33*a* to be soldered to the not-illustrated first circuit board, the bottom plate portion 33 of this modified example includes an extended portion 33*b* formed by extending the bottom plate portion 33 toward the center in the longitudinal direction Y of the connector 1. Moreover, the claw portion 35 that is placed upright in the substantially inverted U shape in such a manner as to extend over the peripheral portion 13 of the socket housing 11 is formed in a terminal end portion in the direction of extension of the extended portion 33*b*. Meanwhile, the lock hole (the lock portion) 37 is formed on a base end portion 35*b* side of the claw portion 35.

This modified example having the above-described configuration can also achieve the same operations and effects as those of the embodiment. Specifically, when the socket 10 and the header 20 are fitting to each other, the lock piece portions 42 can be fitted into the lock holes (the lock portions) 37 by use of resilience of the lock piece portions 42. Thus, it is possible to achieve good feeling at the time of the engagement. Meanwhile, when the socket 10 and the header 20 attempt to be moved in the pullout directions, the lock piece portions 42 and the lock holes (the lock portions) 37 are locked to one another. Thus, it is possible to further reduce the risk of the disengagement between the socket 10 and the header 20.

Figure 9:
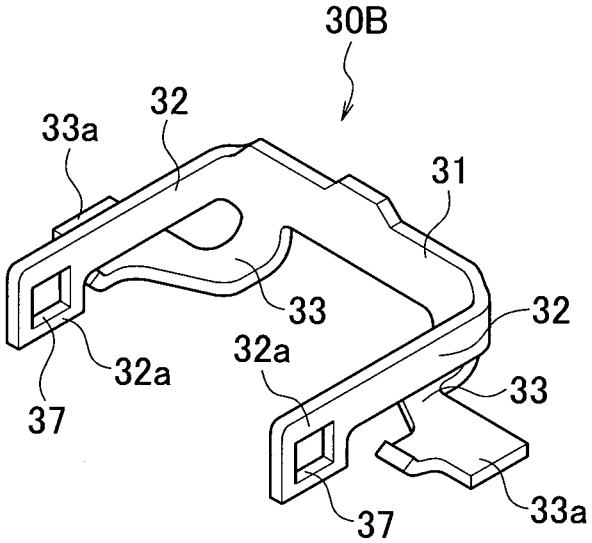
FIG. 9 is a perspective view showing a second modified example of the socket-side holding metal fitting according to the embodiment of the present invention.

FIG. 9 is a perspective view showing a socket-side holding metal fitting 30B of a second modified example. This modified example is different from the embodiment mainly in that the lock hole (the lock portion) 37 is directly formed on the tip end portion 32*a* side of each extended portion 32 of the socket-side holding metal fitting 30B without providing the claw portion to the extended portion 32.

To be more precise, as is the case with the embodiment, the side plate portion 31 of this modified example includes the extended portions 32 formed by bending the two end portions in the width direction X of the side plate portion 31 almost perpendicularly toward the center in the longitudinal direction Y of the connector 1. Here, the side plate portion 31 is formed shorter in the width direction X than that in the embodiment. Thus, each extended portion 32 can be located in an exposed manner toward the inner wall surface side of the peripheral wall portion 13 of the socket housing 11. In this state, the extended portions 32 are integrally formed penetrating through the peripheral wall portion 13 at the two ends in the longitudinal direction Y of the socket housing 11.

This modified example having the above-described configuration can also achieve the same operations and effects as those of the embodiment and the first modified example.

In addition, this modified example does not require the press forming of the claw portions unlike the embodiment and the first modified example. Thus, there is an advantage that it is possible to form the socket-side holding metal fitting 30B more easily.

Figure 10:
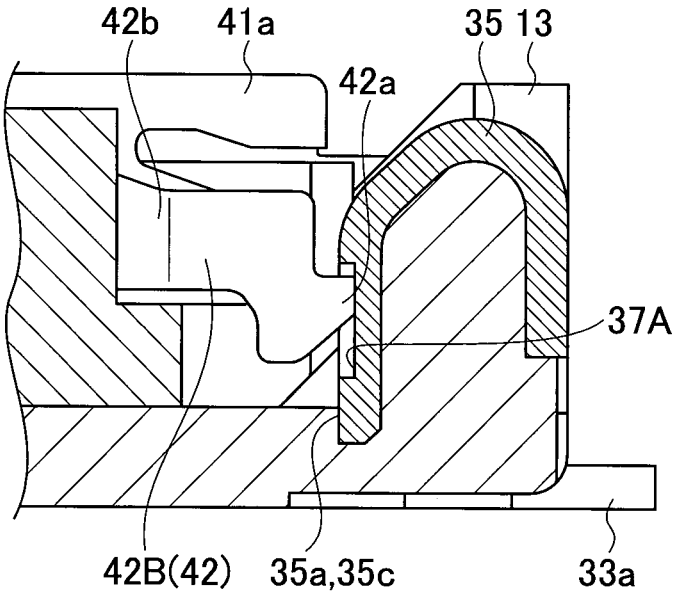
FIG. 10 is a cross-sectional view showing a third modified example of the socket-side holding metal fitting according to the embodiment of the present invention, and illustrating a state in which the third modified example is attached to the socket while viewed from the same position as is the main part of the connector shown in FIG. 7.

FIG. 10 is a cross-sectional view showing a socket-side holding metal fitting 30 of a third modified example. This modified example is different from the embodiment mainly in that each claw portion 35 of the socket-side holding metal fitting 30 is provided with a step portion 37A serving as the lock portion.

Specifically, this modified example uses the step portion 37A, which has a step in the width direction X without penetrating the claw portion 35, in place of the lock hole 37 of the embodiment formed as a through-hole that penetrates the claw portion 35 in the width direction X. Note that the step portion 37A of this modified example is formed as a lock recessed portion by denting part of the claw portion 35 in the width direction X.

This modified example having the above-described configuration can also achieve the same operations and effects as those of the embodiment and the first modified example.

Meanwhile, this modified example uses the step portion 37A as the lock portion, which is formed into the stepped shape without penetrating the claw portion 35 in the width direction X of the socket housing 11. Accordingly, this modified example has an advantage that it is possible to suppress a leakage of a resin forming the socket housing 11 into the step portion (the lock portion) 37A when the socket-side holding metal fitting 30 is formed integrated with the socket housing 11, and thereby to prevent the occurrence of burrs and the like.

This modified example has shown the case of applying the step portion 37A, which is the characteristic portion of the modified example, to the socket-side holding metal fitting 30 of the embodiment. However, this configuration is not limited only to the foregoing but is also applicable to the socket-side holding metal fittings 30A and 30B of the first and second modified examples.

Figure 11:
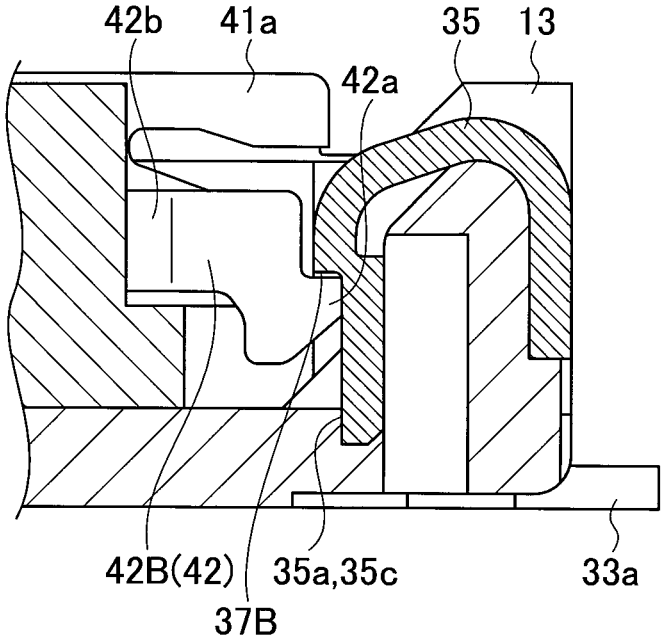
FIG. 11 is a cross-sectional view showing a fourth modified example of the socket-side holding metal fitting according to the embodiment of the present invention, and illustrating a state in which the fourth modified example is attached to the socket while viewed from the same position as is the main part of the connector shown in FIG. 7.

FIG. 11 is a cross-sectional view showing a socket-side holding metal fitting 30 of a fourth modified example. This modified example is different from the embodiment mainly in that, as is the case with the third modified example, each claw portion 35 of the socket-side holding metal fitting 30 is provided with a step portion 37B serving as the lock portion. In this modified example, however, a lock projecting portion formed by causing part of the claw portion 35 to project in away that is the reverse of the claw portion 35 in the third modified example is used as the step portion 37B.

This modified example having the above-described configuration can also achieve the same operations and effects as those of the embodiment and the first modified example.

Meanwhile, this modified example uses the step portion 37B as the lock portion, which is formed by causing part of the claw portion 35 to project. Accordingly, it is possible to adjust a locking amount (a catching amount) of the lock piece portion 42 freely by controlling an amount of projection of the step portion 37B. As a consequence, this modified example has an advantage that it is easy to adjust the pullout forces of the socket 10 and the socket 20, and the click feeling that constitutes the feeling at the time of the engagement thereof.

This modified example has shown the case of applying the step portion 37B, which is the characteristic portion of the modified example, to the socket-side holding metal fitting 30 of the embodiment. However, this configuration is not limited only to the foregoing but is also applicable to the socket-side holding metal fittings 30A and 30B of the first and second modified examples.

Figure 12:
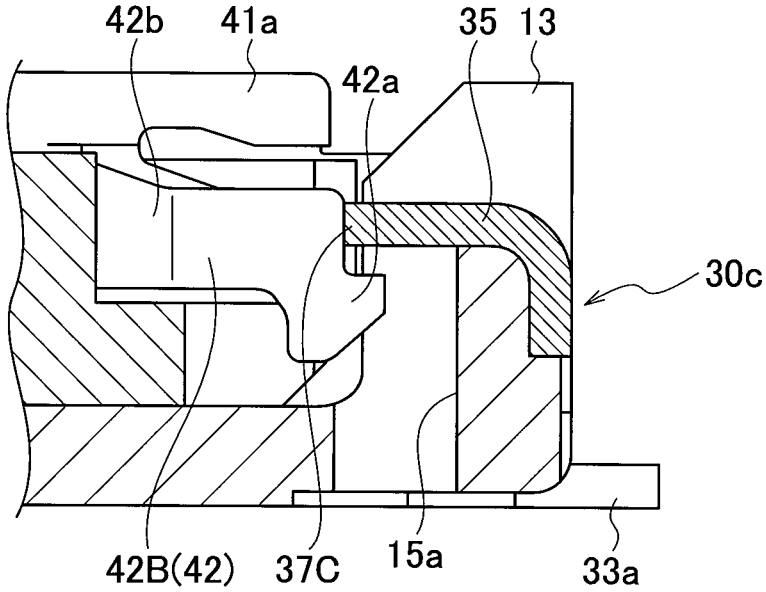
FIG. 12 is a cross-sectional view showing a fifth modified example of the socket-side holding metal fitting according to the embodiment of the present invention, and illustrating a state in which the fifth modified example is attached to the socket while viewed from the same position as is the main part of the connector shown in FIG. 7.
Figure 13:
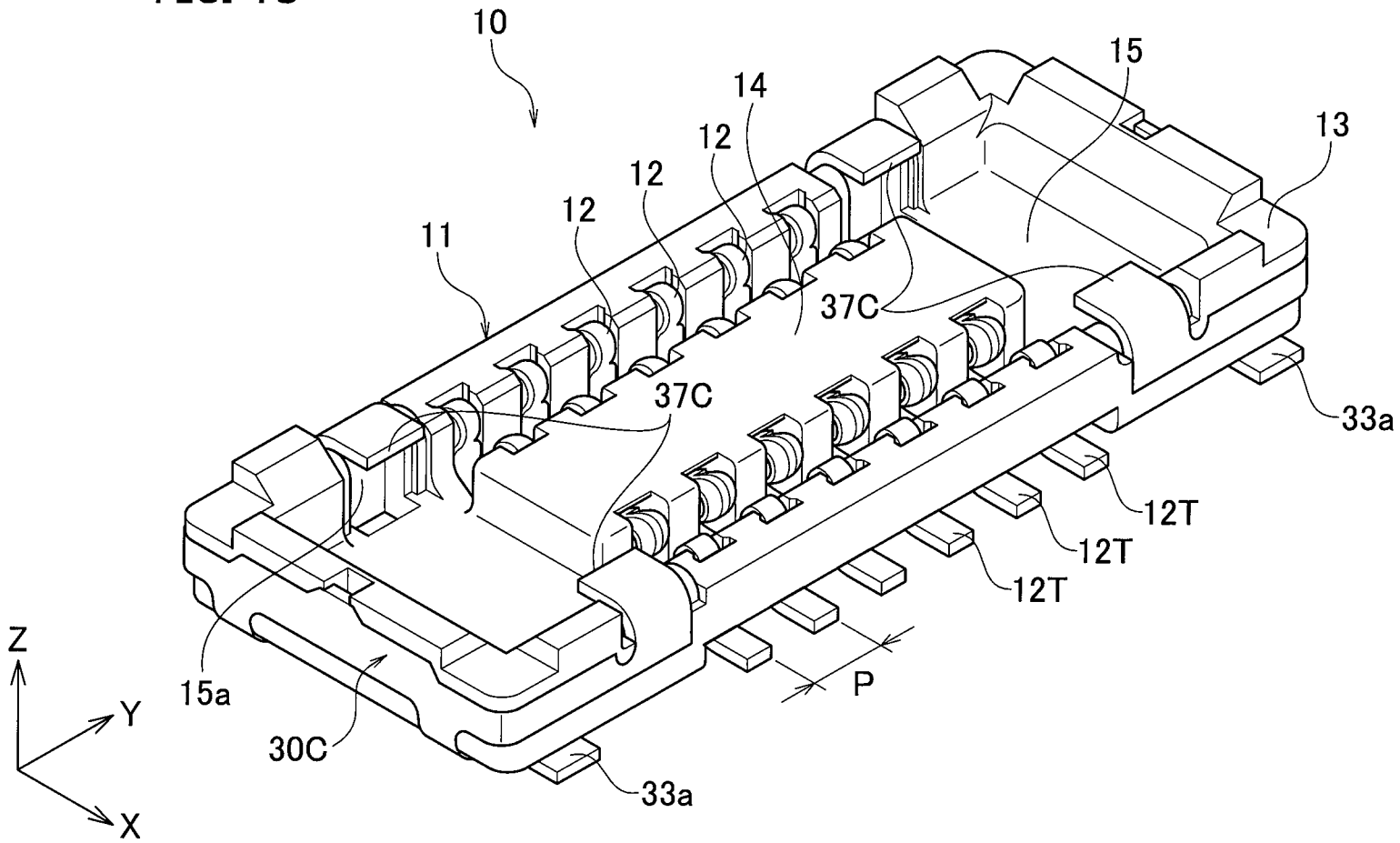
FIG. 13 is a perspective view showing the socket of the connector according to the fifth modified example of the present invention.

FIG. 12 and FIG. 13 are cross-sectional views showing a socket-side holding metal fitting 30C of a fifth modified example. This modified example is different from the embodiment mainly in that the socket-side holding metal fitting 30C is provided with claw portions 35 each projecting inward in the width direction X of the connector 1 (the socket housing 11), and in that tip end portions 37C of the claw portions 35 are used as the lock portions.

In this modified example, each claw portion 35 of the socket-side holding metal fitting 30C is formed substantially into an L shape, and the tip end portion 37C of the claw portion 35 is located in such a manner as to project toward the inner wall surface of the socket housing 11.

This modified example having the above-described configuration can also achieve the same operations and effects as those of the embodiment and the first modified example.

In this modified example, the socket-side holding metal fitting 30C is provided with the claw portions 35 each projecting inward in the width direction X of the connector 1 (the socket housing 11), and the tip end portions 37C of the claw portions 35 are used as the lock portions. Accordingly, in addition to an advantage that it is possible to achieve the same operations and effects as those of the fourth modified example, there is another advantage that it is possible to conduct machining of the socket-side holding metal fitting 30C easily.

Although the preferred embodiments of the present invention have been described above, the present invention is not limited only to the above-described embodiments, and various modifications are possible.

For example, although the embodiment shows the case where each of the socket and the header has a rectangular shape, the present invention is also applicable to a case where the socket and the header have other shapes.

Meanwhile, the above-described embodiments show the case where the lock piece portions of the header-side holding metal fittings are made expandable and contractible (elastically deformable) in the width direction of the connector (the header housing). However, the present invention is not limited only to this configuration. For example, the lock piece portions may be held projectable and retractable in the width direction with respect to the base portions (the connection pieces in the embodiments).

It is to be also noted that the detailed specifications (the shapes, sizes, layouts, and the like) of the contacts, the posts, and others may also be changed as appropriate.

REFERENCE SIGNS LIST

1 connector
10 socket
11 socket housing (socket body)
12 socket-side terminal (contact)
20 header
21 header housing (header body)
22 header-side terminal (post)
30, 30A, 30B, 30D socket-side holding metal fitting
37 lock hole (lock portion)
37A step portion (lock portion)
37B step portion (lock portion)
37C tip end portions (lock portion)
40 header-side holding metal fitting
42 lock piece portion
X width direction of connector (socket housing, header housing)
Y longitudinal direction of connector (socket housing, header housing)
Z vertical direction of connector (socket housing, header housing)

The invention claimed is:

1. A socket comprising a socket body, on which socket-side terminals arranged at an engagement groove portion and a socket-side holding metal fitting are disposed, and being configured to engage the engagement groove portion of the socket body with a peripheral wall portion of a header body, on which header-side terminals arranged at the peripheral wall portion and a header-side holding metal fitting are disposed, and thereby to bring the socket-side terminals and the header-side terminals into contact, wherein the header-side holding metal fitting includes a lock piece portion being movable in a width direction of the header body relative to a base portion of the header-side holding metal fitting, and the socket-side holding metal fitting includes a lock portion lockable to the lock piece portion.

2. The socket of claim 1, wherein the lock portion of the socket-side holding metal fitting is provided on two sides or one side of a peripheral wall portion in a width direction of the socket body so as to be situated in a line with the socket-side terminals.

3. The socket of claim 1, wherein the lock portion is a lock hole formed in a penetrating manner in the width direction of the socket body.

4. The socket of claim 1, wherein the lock portion is a step portion having a step in the width direction of the socket body.

5. The socket of claim 1, wherein the socket-side holding metal fitting includes a claw portion projecting inward in the width direction of the socket body, and a tip end portion of the claw portion serves as the lock portion.

6. The socket of claim 1, wherein the socket-side holding metal fitting includes a claw portion bent substantially into an inverted U shape in such a manner as to extend over a peripheral wall portion of the socket body, and the lock portion is formed in the claw portion.

7. The socket of claim 6, wherein the tip end portion of the claw portion is buried in the socket body.

8. A connector comprising the socket according to claim 1.

* * * * *